US008016605B2

(12) United States Patent
Montena et al.

(10) Patent No.: US 8,016,605 B2
(45) Date of Patent: Sep. 13, 2011

(54) CONNECTOR SLEEVE AND METHOD OF USE THEREOF

(75) Inventors: Noah Montena, Syracuse, NY (US); Christopher P. Natoli, Fulton, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 162 days.

(21) Appl. No.: 12/485,432

(22) Filed: Jun. 16, 2009

(65) Prior Publication Data

US 2010/0317225 A1 Dec. 16, 2010

(51) Int. Cl.
*H01R 9/05* (2006.01)

(52) U.S. Cl. ..... 439/322; 81/121.1

(58) Field of Classification Search ..... 439/322, 439/320, 578; 81/121.1, 124.2; 285/38
See application file for complete search history.

(56) References Cited

U.S. PATENT DOCUMENTS

| | | | | | |
|---|---|---|---|---|---|
| 3,907,399 | A | | 9/1975 | Spinner | |
| 4,058,031 | A | * | 11/1977 | Magarian | 81/64 |
| 4,290,663 | A | | 9/1981 | Fowler et al. | |
| 4,377,320 | A | | 3/1983 | Lathrop et al. | |
| 4,662,693 | A | | 5/1987 | Hutter et al. | |
| 4,805,933 | A | * | 2/1989 | Swisher | 285/38 |
| 5,002,503 | A | | 3/1991 | Campbell et al. | |
| 5,067,750 | A | * | 11/1991 | Minneman | 285/38 |
| 5,217,393 | A | | 6/1993 | Del Negro et al. | |
| 5,295,864 | A | | 3/1994 | Birch et al. | |
| 5,297,458 | A | * | 3/1994 | Smith et al. | 81/124.3 |
| 5,316,348 | A | * | 5/1994 | Franklin | 285/39 |
| 5,367,925 | A | * | 11/1994 | Gasparre | 81/121.1 |
| 5,470,257 | A | | 11/1995 | Szegda | |
| 5,501,616 | A | | 3/1996 | Holliday | |
| 5,525,076 | A | | 6/1996 | Down | |
| 5,632,651 | A | | 5/1997 | Szegda | |
| 5,667,405 | A | | 9/1997 | Holliday | |
| 5,857,865 | A | | 1/1999 | Shimirak et al. | |
| 5,975,951 | A | | 11/1999 | Burris et al. | |
| 6,027,373 | A | | 2/2000 | Gray et al. | |
| 6,102,738 | A | | 8/2000 | Macek et al. | |
| 6,168,455 | B1 | | 1/2001 | Hussaini | |
| 6,179,660 | B1 | | 1/2001 | Salaguinto et al. | |
| 6,210,222 | B1 | | 4/2001 | Langham et al. | |
| 6,282,994 | B1 | * | 9/2001 | Wei | 81/121.1 |
| 6,322,390 | B1 | | 11/2001 | Takeuchi | |
| 6,817,272 | B2 | * | 11/2004 | Holland | 81/124.2 |
| 6,971,912 | B2 | | 12/2005 | Montena et al. | |
| 7,097,500 | B2 | * | 8/2006 | Montena | 439/587 |
| 7,147,509 | B1 | * | 12/2006 | Burris et al. | 439/578 |
| 7,513,795 | B1 | * | 4/2009 | Shaw | 439/578 |
| 7,618,276 | B2 | * | 11/2009 | Paglia et al. | 439/322 |
| 7,837,501 | B2 | * | 11/2010 | Youtsey | 439/578 |
| 2001/0034159 | A1 | | 10/2001 | Pitschi | |
| 2004/0194585 | A1 | * | 10/2004 | Clark | 81/124.2 |
| 2010/0022120 | A1 | * | 1/2010 | Bradley | 439/578 |
| 2010/0199813 | A1 | * | 8/2010 | Phillips et al. | 81/124.2 |

* cited by examiner

*Primary Examiner* — Neil Abrams
(74) *Attorney, Agent, or Firm* — Schmeiser, Olsen & Watts, LLP

(57) ABSTRACT

Disclosed herein is a connector sleeve includes a first rib portion consisting essentially of a first material, and a second web portion consisting essentially of a second supple material and attached to the first rib portion to define the sleeve. The second supple material is softer and more elastic than the first material, and the sleeve is dimensioned to circumferentially surround a revolving portion of a connector in an interference fit such that rotation of the sleeve causes rotation of the revolving portion. The sleeve may be used to enhance torque for rotation of a nut used on a coaxial cable connector.

20 Claims, 8 Drawing Sheets

CONNECTOR SLEEVE AND METHOD OF USE THEREOF

FIELD OF THE INVENTION

The subject matter disclosed herein relates generally to coaxial cable connectors. More particularly, this invention provides for a torque enhancing sleeve for a coaxial cable connector.

BACKGROUND OF THE INVENTION

When transmitting signals through coaxial cables that are connected by connectors, it is very important that the connectors are tightly secured so that stable electrical conditions prevail inside the connector. Typical coaxial cable connectors include a revolving nut that is configured to rotate freely with respect to the connector and the attached cable. The nut includes internal threads that allow the nut to engage with an interface port having external threads. However, it is often difficult for an installer to sufficiently tighten the nut by hand with the force required to assure stable electrical conditions and a proper connection. For this reason, torque enhancing sleeves have been implemented that attach to, and rotate with, the nut. The nut is typically slid into the sleeve and retained substantially with an interference fit between the nut and the sleeve. Materials used for the manufacture of connector sleeves are typically low in cost, easily formable, and wear resistant. Polyoxymethylene plastic has all of these advantageous properties and is often used in the manufacture of connector sleeves. However, due to the lack of resistance to permanent deformation of Polyoxymethylene, sleeves constructed of this material are permanently deformed after attachment to a first connector such that subsequent attachments to other connectors result in an interference fit with reduced retention strength. Additionally, because Polyoxymethylene has a low coefficient of friction, the outer walls of a sleeve are typically knurled in order to enhance grip during a tightening process.

Accordingly, an improved connector sleeve would be well received in the art.

BRIEF DESCRIPTION OF THE INVENTION

According to one aspect of the invention, a connector sleeve comprises a first rib portion consisting essentially of a first material, and a second web portion consisting essentially of a second supple material and attached to the first rib portion to define the sleeve, the second supple material softer and more elastic than the first material, wherein the sleeve is dimensioned to circumferentially surround a revolving portion of a connector in an interference fit such that rotation of the sleeve causes rotation of the revolving portion.

According to another aspect of the invention, a method of forming a sleeve for a connector comprises molding a first rib portion consisting essentially of a first material, the first rib portion having a first annular section and at least a first finger extending therefrom, molding a second web portion of a sleeve consisting essentially of a second supple material, the second supple material softer and more elastic than the first material, the second web portion having a second annular section and at least a second finger extending therefrom, and joining the first and second portions such that the fingers define walls of the sleeve and the annular sections define opposing ends of the sleeve.

According to yet another aspect of the invention, a method for engaging a connector with a port comprises providing a cable connector with a sleeve, the sleeve including a first rib portion consisting essentially of a first material and a second web portion consisting essentially of a second supple material, the second supple material having a greater coefficient of friction and more elastic than the first material, wherein the sleeve circumferentially surrounds a revolving portion of a cable connector in an interference fit such that rotation of the sleeve causes rotation of the revolving portion. The method further comprises engaging the revolving portion with a port and rotating the sleeve.

According to yet another aspect of the invention, a connector sleeve comprises a first rib portion consisting essentially of a first material, the first rib portion having a first annular section and a first finger extending therefrom, the first rib portion dimensioned to at least partially surround a revolving portion of a connector in an interference fit, a second web portion consisting essentially of a second supple material, the second supple material softer and having a greater resistance to permanent deformation than the first material, the second web portion having a second annular section and a second finger extending therefrom and a means for joining the first rib portion to the second web portion such that the fingers define the walls of the sleeve and the annular sections define the ends of the sleeve.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed apparatus and method are presented herein by way of exemplification and not limitation with reference to the Figures.

Figure 1:
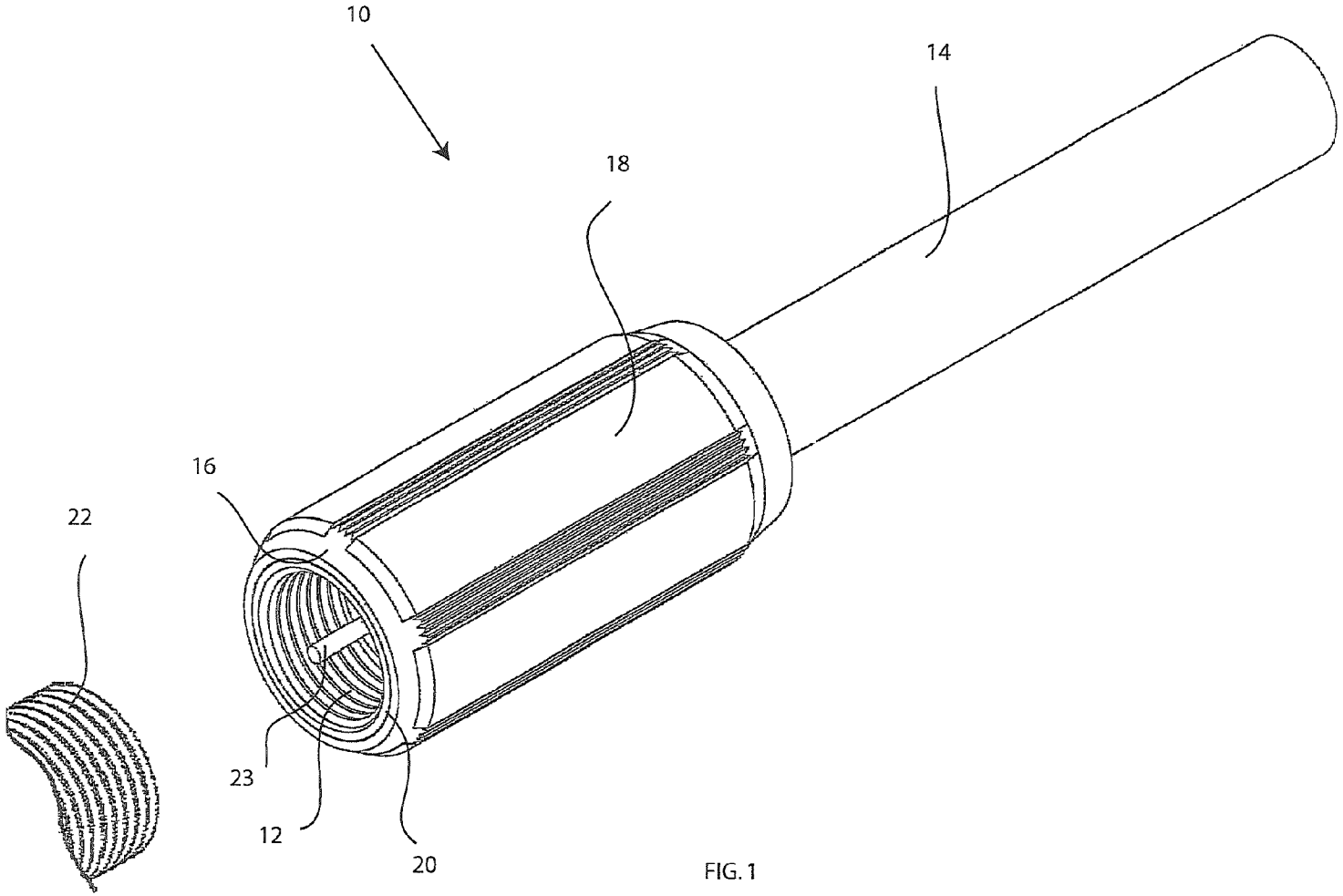
FIG. 1 depicts a perspective view of a connector sleeve attached to a cable connector according to one embodiment of the present invention.

Referring to FIG. 1, a perspective view of an embodiment of a sleeve 10 is shown attached to a cable connector 12 of a coaxial cable 14. The sleeve 10 includes a first rib portion 16 that consists essentially of a first material, such as a Polyoxymethylene plastic. The sleeve includes a second web portion 18 adjoined or attached to the first rib portion 16. The first and second portions 16, 18 define the sleeve 10. The second web portion 18 consists essentially of a second supple material that is softer and more elastic than the first material, such as a silicone rubber. The second supple material may have a greater coefficient of friction than the first material and may also have a higher resistance to permanent deformation than the first material. Additionally, the second supple material may be softer and more elastic than the first material. The sleeve 10 is dimensioned to circumferentially surround a revolving portion 20 of the cable connector 12 in an interference fit such that rotation of the sleeve 10 causes rotation of the revolving portion 20. Because of the softer and more elastic properties of the second supple material, the second web portion 18 allows the sleeve 10 to temporarily deform under the interference fit with the revolving portion 20. Thus, the sleeve 10 may be removed and applied to subsequent connectors while retaining the retention strength of the interference fit. In use, an operator (not shown) may engage the revolving portion 20 with a port 22 and rotate the sleeve 10 to achieve a tight and stable electrical connection between the cable 14, the connector 12, and the port 22. The second supple material may also have a high coefficient of friction with skin, gloves or another contact surface to enhance the operator's ability to apply torque to the revolving portion 20.

It should be understood that the first material of the first rib portion 16 is not limited to a Polyoxymethylene plastic, but might be ABS, polycarbonate, high density polyethylene, polypropylene polyvinyl chloride (PVC), or other moldable materials that may form a rigid rib portion, while being compatible with co-molding of a second supple material. The second supple material of the second web portion 18 may be comprised of silicone rubber; but it is not limited to a silicone rubber; other supple materials such as polyisoprene or natural rubber, polybutadiene, polyisobutylene, and polyurethane, or other moldable elastomeric materials that may form a supple web portion, while being compatible with co-molding and/or assembly of a first rib portion formed of a first more rigid material. The second supple material may be soft; pliable; readily yieldable to touch or pressure; capable of returning to its original length, shape, etc., after being stretched, deformed, compressed, or expanded; flexible; accommodating; adaptable; tolerant; springy, and/or plastically malleable. Such supple characteristics may enhance the ability of a user to grip or grasp the second web portion 18 of the sleeve 10.

Various material combinations may be employed to form the first rib portion 16 and the second web portion 18 of the sleeve 10, and the material combinations may have advantageous properties suitable for the purposes of the present invention. Particularly, Polyoxymethylene plastic has a density of 1.4-1.5 g/cm, a Rockwell hardness of M 94, and a melting temperature of about 350° F. Polyoxymethylene is a lightweight, low-cost, and wear-resistant thermoplastic with good physical and processing properties and capable of operating in temperatures in excess of 200° F. Other plastics having advantageous properties similar to Polyoxymethylene will be apparent to those skilled in the art. For example, the first material may be any type of appropriate plastic such as ABS, polycarbonate, high density polyethylene, polypropylene polyvinyl chloride (PVC), or other moldable materials that may form a rigid rib portion, while being compatible with co-molding of a second supple material. Bonding between the first more rigid material and the second supple material of the first and second portions is advantageous.

Silicone rubber, on the other hand, has advantageous properties such as good thermal stability, constancy of properties over a wide temperature range leading to large operating range (e.g. −150 to 500° F.), ability to repel water and form water tight seals, flexibility, good electrical insulation, low chemical reactivity, and a high coefficient of friction with skin. Any particular type of silicone rubber may be appropriate. However, other rubbers having advantageous properties similar to silicone rubber will be apparent to those skilled in the art. For example, the second supple material may be any type of appropriate rubber-like or elastomeric material such as polyisoprene or natural rubber, polybutadiene, polyisobutylene, and polyurethane, or other moldable elastomeric materials that may form a supple web portion, while being compatible with co-molding and/or assembly of a first rib portion formed of a first more rigid material.

Figure 2:
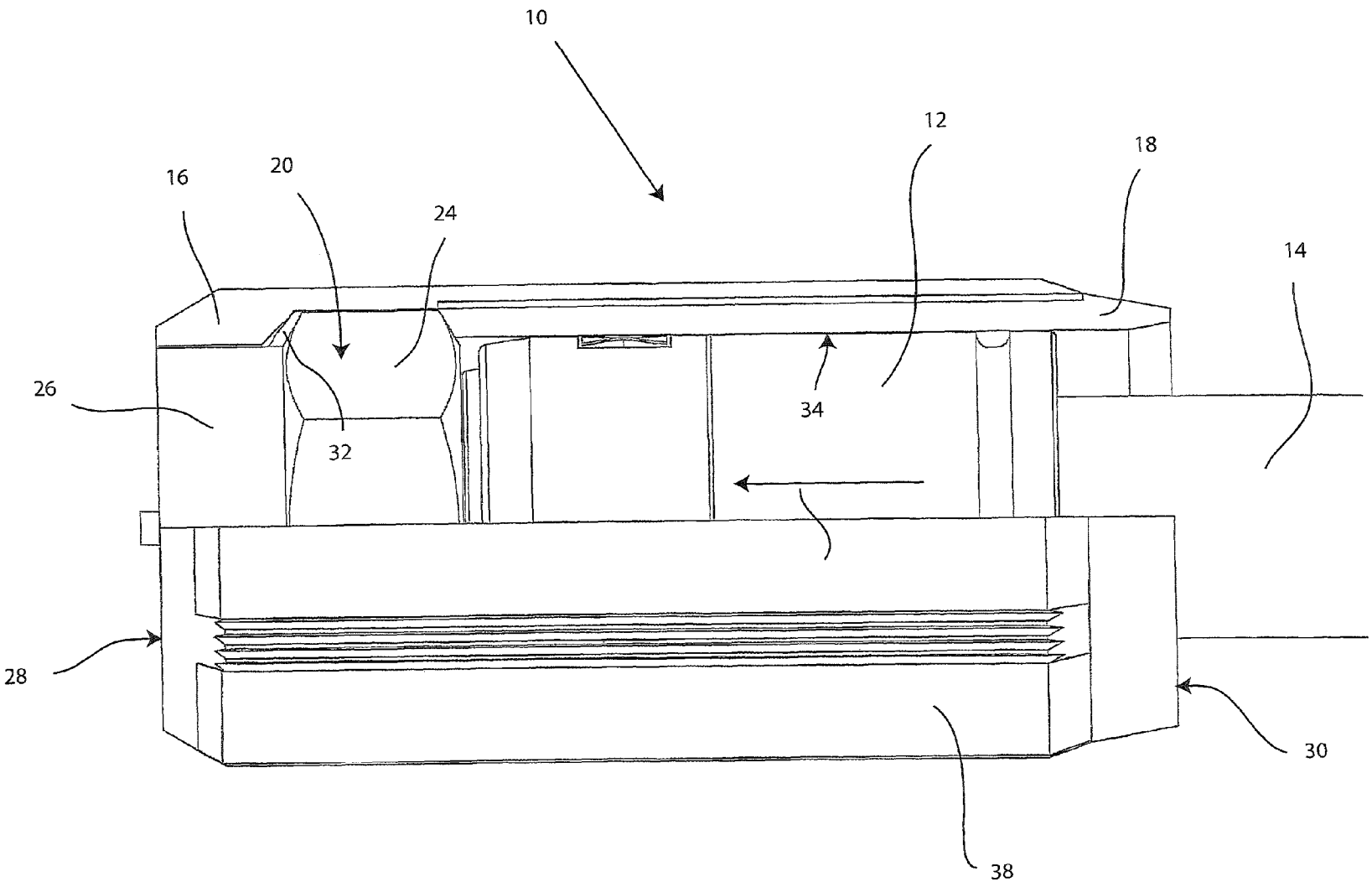
FIG. 2 depicts a side cutaway view of the connector sleeve of FIG. 1.

Shown in FIG. 2 is a side cutaway view of the sleeve 10 attached to the cable connector 12 of the cable 14. The cable connector 12 is a compressible connector and is shown after having been compressed for attachment to the cable 14, as is generally known to those skilled in the art. The cable connector 12 may be an F-type connector, or other type of connector as is known to those skilled in the art. It should be understood that the cable 14 may be a coaxial cable having a center conductor 23 for communicating an electromagnetic signal therethrough, however other types of cables and connectors are contemplated. The revolving portion 20 of the cable connector 12 may include a hollowed hexagonal nut section 24 and a smooth circular section 26, each having internal threads configured to rotate with respect to the rest of the sleeve 10. Rotation of the revolving portion 20 facilitates attachment to the externally threaded interface port 22. It should be understood that the invention is not limited to a sleeve attachable only to a hexagonal nut cable connector, such as the cable connector 12. The sleeve 10 may also be dimensioned for a connector of any shape and having any shaped revolving portion, such as a circular nut, square, or other polygonal or smooth shape. It is contemplated that the invention may be adapted for use on any connector having a revolving portion that rotates with respect to the connector to facilitate attachment to a port.

Referring still to FIG. 2, the sleeve is substantially hollow and includes a first end 28 and a second end 30. The cable connector 12 may be inserted into the second end 30, in a direction A. The connector may be received into an annular recess 32 on an inner wall 34 of the sleeve 10 located proximal to the first end 28. The annular recess 32 may be dimensioned to have an interference fit with the revolving portion 20 of the cable connector 12. In the embodiment shown in the Figures, the annular recess 32 is a hexagonal recess dimensioned to have an interference fit with the hexagonal nut revolving portion 20. In other words, the sleeve 10 is dimensioned to circumferentially surround the hexagonal nut revolving portion 20. Thus, rotation of the sleeve 10 causes rotation of the revolving portion 20.

Figure 3:
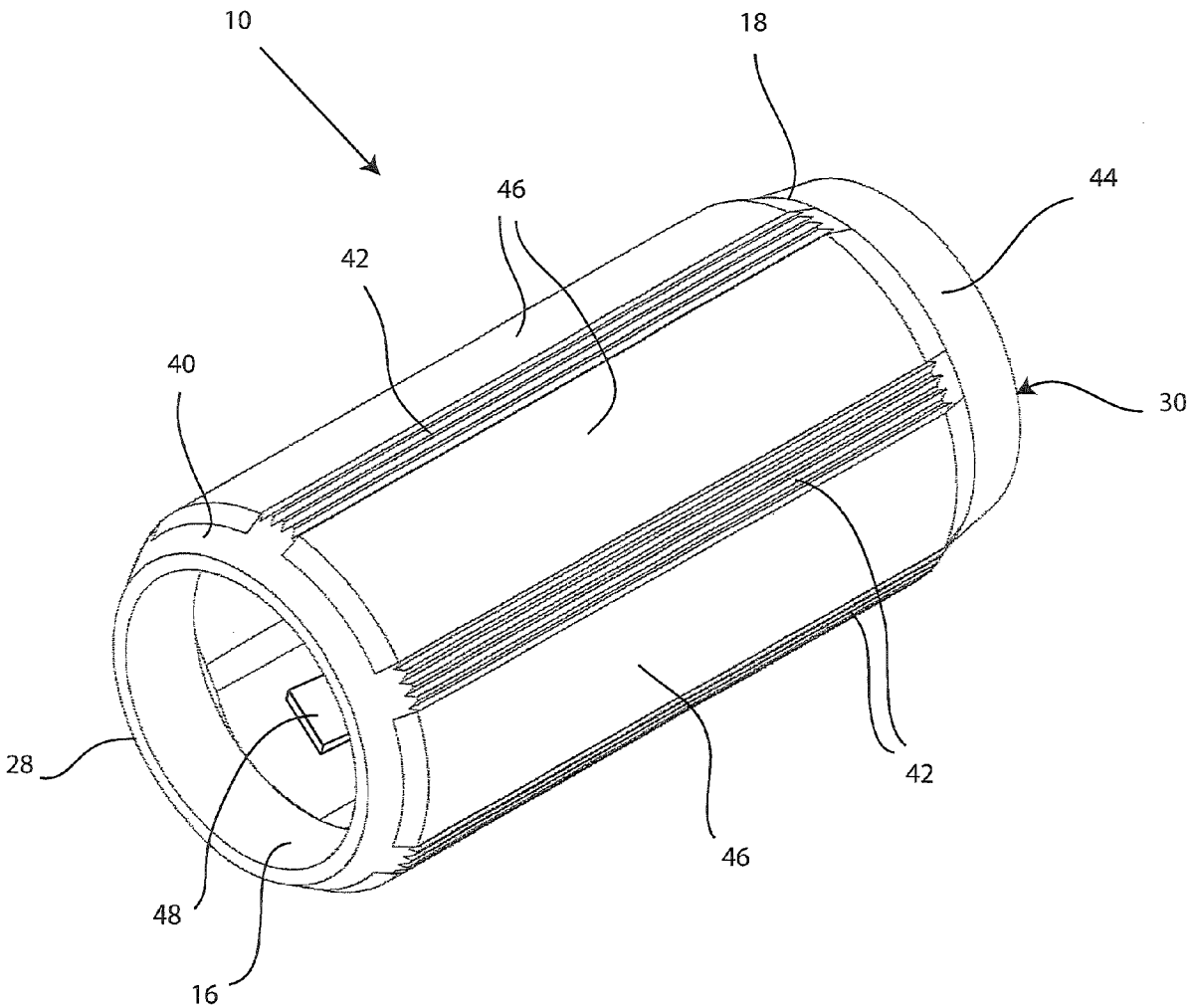
FIG. 3 depicts a perspective view of a connector sleeve according to one embodiment of the present invention.
Figure 4:
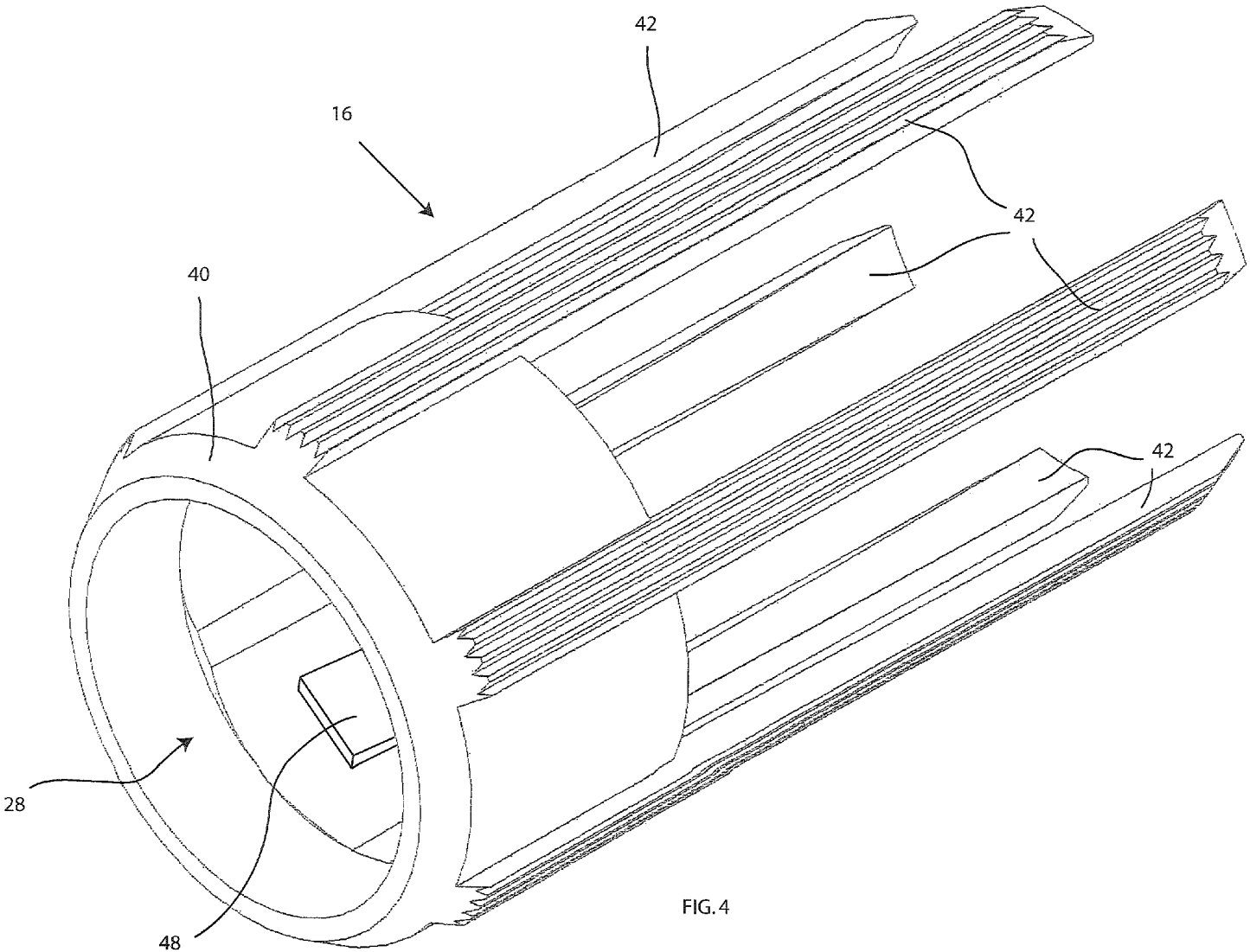
FIG. 4 depicts a first rib portion of the connector sleeve of FIG. 3.
Figure 5:
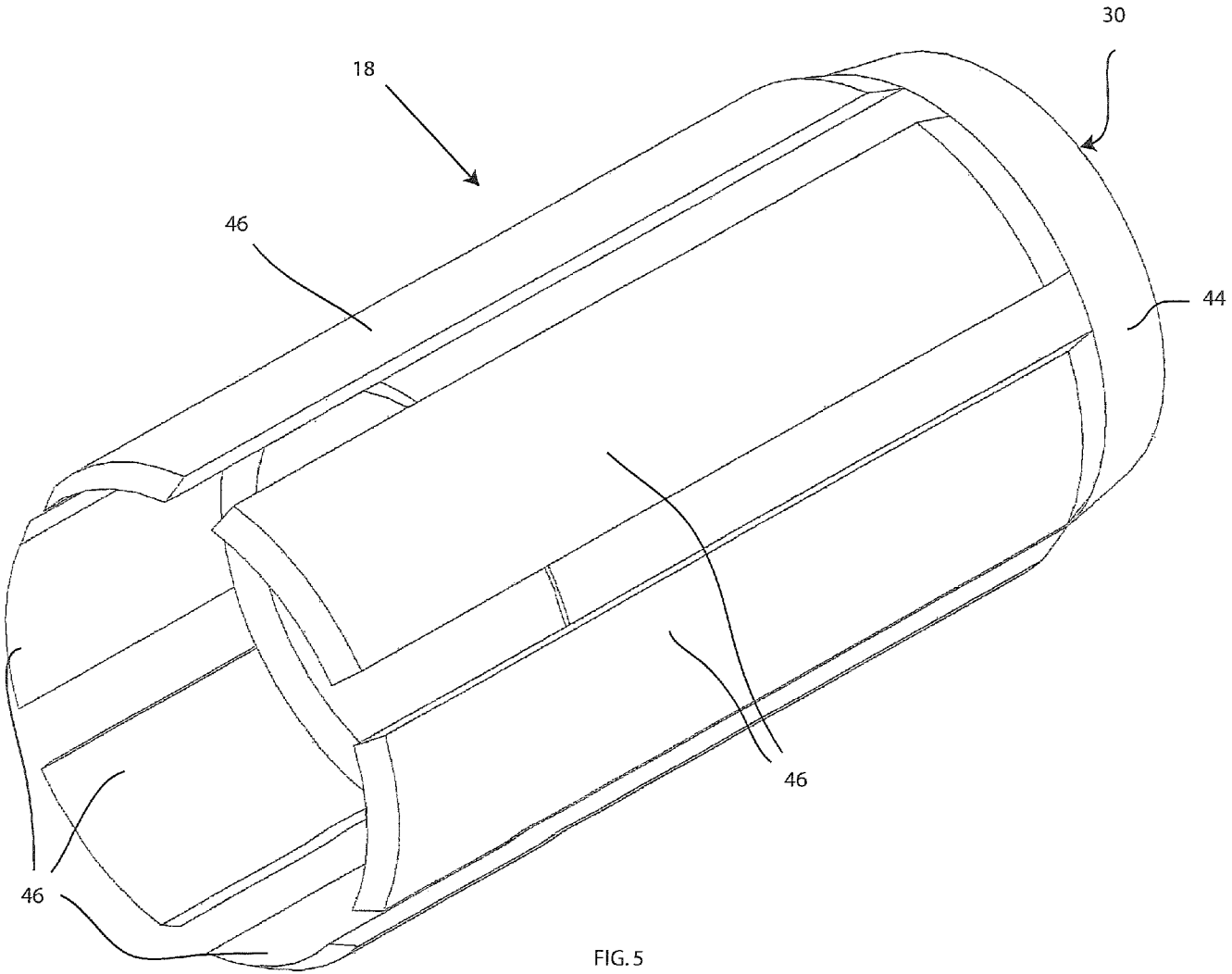
FIG. 5 depicts a second web portion of the connector sleeve of FIG. 3.

FIGS. 3-5 depict embodiments of the sleeve 10 shown in FIGS. 1-2. Particularly, FIG. 3 shows the sleeve 10 prior to attachment of the cable connector 12. FIG. 4 shows only the first rib portion 16 of the sleeve prior to the joining with the second web portion 18, while FIG. 5 shows only the second web portion 18 prior to the joining with the first rib portion 16. The sleeve 10 is hollow, and the inner wall 34 contacts the connector 12, and an outer surface 38 may be gripped by a user when rotating the sleeve 10.

The first rib portion 16 is shown having a first annular section 40. The first annular section 40 has a diameter smaller than the dimensions of the revolving portion 20 such that the first annular section 40 will prevent movement of the revolving portion 20 there through. However, the diameter of the first annular section 40 may be dimensioned to provide interference fit with the smooth circular section 26 of the revolving portion 20.

A first plurality of fingers 42 extend from the first annular section 40. Particularly, the first annular section 40 is shown having six of the fingers 42. However the first annular section 40 may include any number of appropriate fingers. The fingers 42 may extend a substantial length of the sleeve 10, but may alternately extend only a partial length of the sleeve 10. Furthermore, the outer surface 38 of the fingers 42 may be knurled or otherwise structurally formed to enhance grip during rotation of the sleeve 10 by a user. As shown in the Figures, longitudinal knurls or ribs are included on each of the fingers 42. The fingers 42 may or may not be knurled, and it should be understood that the knurls may have any pattern such as cross knurling, or may be a plurality of protrusions or detents. Additionally, the annular section 40 may extend a partial length of the fingers 42 in order to provide additional support for the sleeve 10, as shown in FIG. 4.

The first rib portion 16 of the sleeve 10 may be created by a molding process. For example, a mold cavity may be created and the first material, heated to liquid form, may be poured or injected there and formed. The first rib portion 16 may then be allowed to cool, thereby permanently form the first rib portion 16. Any appropriate molding process may be used. Alternately, other manufacturing process may be used to define the sleeve. Machining processes, such as turning, milling, screw machining, or the like may be used in the case that the first material is a metal. Appropriate processes to manufacture or create the first rib portion 16 will be apparent to those skilled in the art.

It is also contemplated that the connector sleeve 10 includes more than two portions 16, 18. For example, the connector sleeve 10 may be multilayered, having a web portion molded onto a rib portion, then having a rib portion molded onto the web portion thereafter. Any combination of portions 16, 18 may be layered to define the sleeve 10, as contemplated by the present invention.

The second web portion 18 is shown having a second annular section 44 located opposite the first annular section 40. The second annular section 44 may have a diameter larger than the dimensions of the revolving portion 20 such that the second annular section 44 will allow reception of the revolving portion 20 within the sleeve 10. Alternately, the second annular section 44 may have a smaller dimension than the revolving portion 20, but may be configured to expand in order to receive the revolving portion 20. This may be because the second web portion 18 is made of a softer, more flexible second supple material such as silicone rubber. In any case, the second annular section 44 may have a larger diameter than the rest of the connector 12 or the cable 14 such that rotation of the sleeve 10 is not interfered with by friction between the second annular section and the connector 12 or the cable 14.

A second plurality of fingers 46 extend from the second annular section 44. Particularly, the second annular section 44 is shown having six of the fingers 46. However the second annular section 44 may include any number of appropriate fingers. Additionally, the number of fingers 46 extending from the second annular section 44 may be equal to the number of fingers 42 extending from the first annular section 40 such that the fingers interlock when the first and second portions 16, 18 are joined. The second plurality of fingers 46 may extend a substantial length of the sleeve 10, but may alternately extend only a partial length of the sleeve. Furthermore, the outer surface 38 of the fingers 46 may or may not be knurled or otherwise structurally shaped to enhance grip during rotation of the sleeve 10 by a user. As shown in the Figures, the fingers 46 may not be knurled. This is because the second supple material has a high coefficient of friction. Additionally, the annular section 44 may extend a partial length of the fingers 46 in order to provide additional support for the sleeve 10, as shown in FIG. 4.

The second web portion 18 of the sleeve 10 may also be created by a molding process. Like the first rib portion 16, a mold cavity may be created and the second supple material, heated to liquid form, may be poured or injected there and formed. The second web portion 18 may then be allowed to cool, thereby permanently form the second web portion 18. Any appropriate molding process may be used. Alternately, other manufacturing process may be used to define the sleeve. Machining processes, such as turning, milling, screw machining, or the like may be used in the case that the first material is a metal. Appropriate processes to manufacture or create the second web portion 18 will be apparent to those skilled in the art.

Furthermore, the joining of the first rib portion 16 with the second web portion 18 may comprise an overmolding process. For instance, the second web portion may be overmolded onto the first rib portion 16 while the second web portion 18 is still hot from being molded. However, while overmolding may be one means for joining the first rib portion 16 with the second web portion 18, other means are contemplated. For example, an epoxy, glue, or other such adhesive bonding may be used. Alternately, the first and second portions 16, 18 may be dimensioned for an interference fit. In this embodiment, the second web portion 18 may be configured to slightly expand when fit with the first rib portion 16, resulting in a permanent retaining force between the two portions 16, 18. Another means may be that the first and second portions 16, 18 snap or structurally lock together.

Thus, whatever the means of joining the first and second portions 16, 18, when they are joined together the sleeve 10 has a substantially hollow shape. The opposing ends of the sleeve 10 may be substantially defined by the annular sections 40, 44, and the walls of the sleeve 10 may be substantially defined at least in part by the interlocked fingers 42, 46. At least part of the first rib portion 16 may be dimensioned to partially surround the revolving portion 20 of the cable connector 12. The second web portion 18 is configured to expand to accommodate the revolving portion 20 into the annular recess 32 in the inner surface 36 of the sleeve 10 in an interference fit. The annular recess 32 may be defined by recesses within both the first and second portions 16, 18, or the fingers 42, 46 associated therewith. Alternately, the annular recess 32 may be defined within only one of the first and second portions 16, 18. In any case, the second web portion 18 is made of a second supple material that is resistant to permanent deformation such that the sleeve 10 retains retention strength when attached to multiple connectors. In one embodiment, this is achieved because the second web portion 18 is directly in contact with the revolving portion 20, and thereby undeforms when the sleeve 10 is removed from the connector 12 in order to retain its dimensions for a tight interference fit with a later connector. However, in another embodiment the second web portion 18 may instead snugly surround the first rib portion 16 without directly contacting the revolving portion 20 with only the first rib portion 16 in direct contact. In this embodiment, the second web portion 18 may apply radial pressure on the outer wall the first rib portion 16 in order for the first rib portion 16 to retain retention strength and interference fit integrity when used on subsequent connectors.

Furthermore, as shown in FIGS. 3-4, at least one of the first rib portion 16 and the second web portion 18 may include protrusions 48 located on the inner wall 34 configured to help retain the revolving portion 20 within the sleeve 10. It should be understood that the protrusions 48 may be bumps, projections, ribs, nubs, lips or other like structures. The protrusions 48 may be used as an alternative to defining the profile of the annular recess 32 to completely retain both sides of the hexagonal nut 24 of the revolving portion 20 in an interference fit. In an embodiment having the protrusions 48, the inner wall 34 of the sleeve 10, between the protrusions 48 and the second annular section 44, may have a diameter that is dimensioned to provide sufficient clearance for the hexagonal nut 24 of the connector 12 without deformation. Insertion of the hexagonal nut 24 past the protrusions 48 causes the sleeve 10 to temporarily expand until the revolving portion 20 clears the protrusions 48 and is retained within the annular recess 32 defined by the protrusions 48 and a reduced diameter profile of the first annular section 40.

Figure 6:
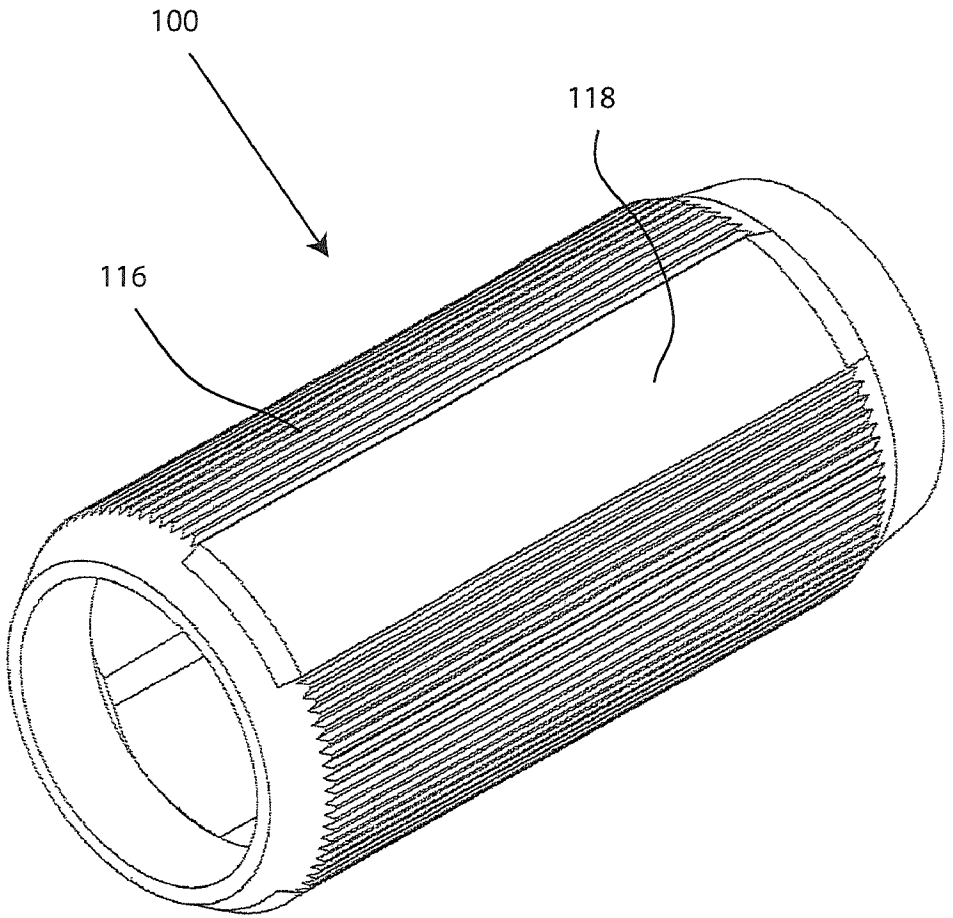
FIG. 6 depicts a perspective view of a connector sleeve according to one embodiment of the present invention.
Figure 7:
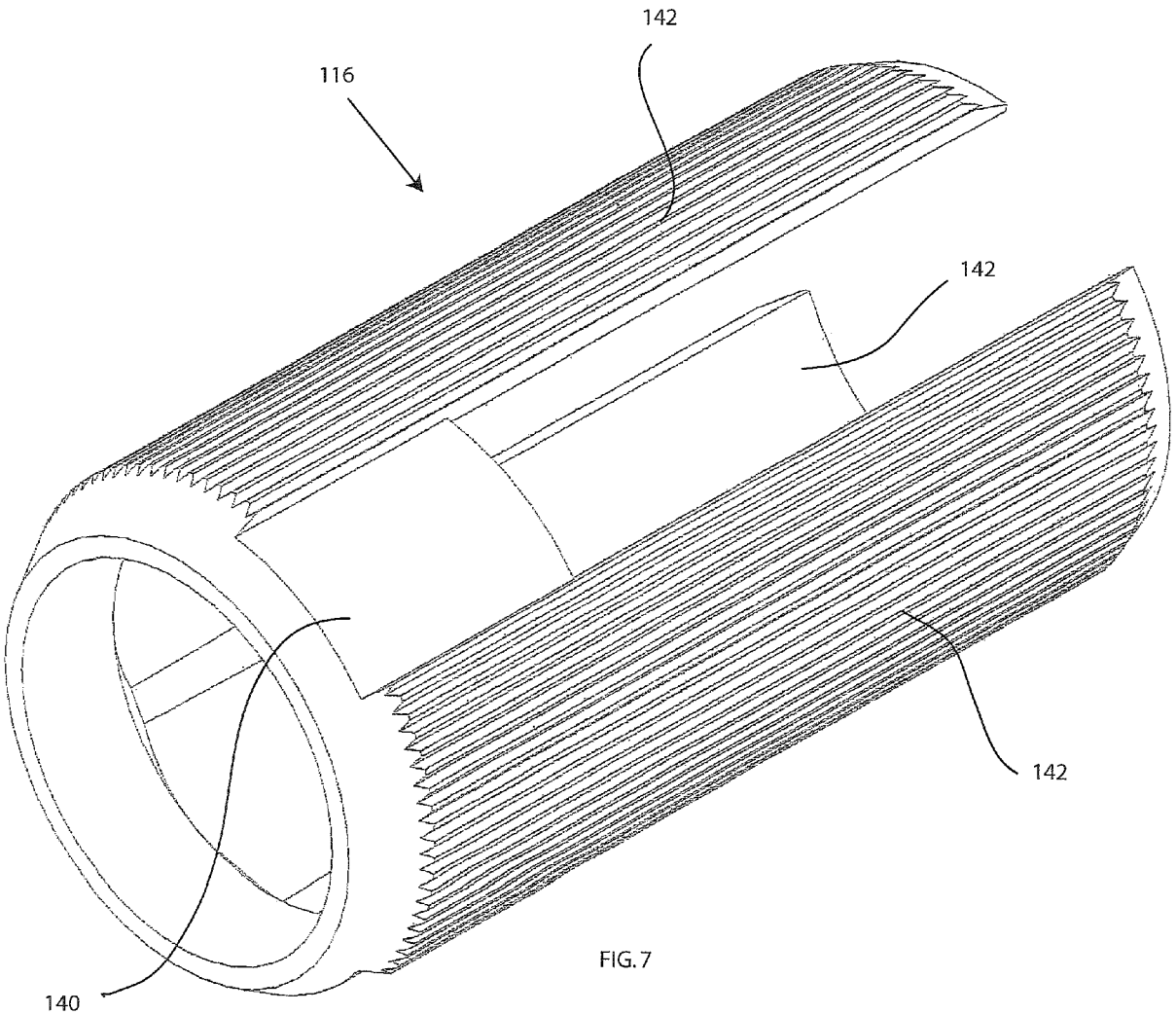
FIG. 7 depicts a first rib portion of the connector sleeve of FIG. 6.
Figure 8:
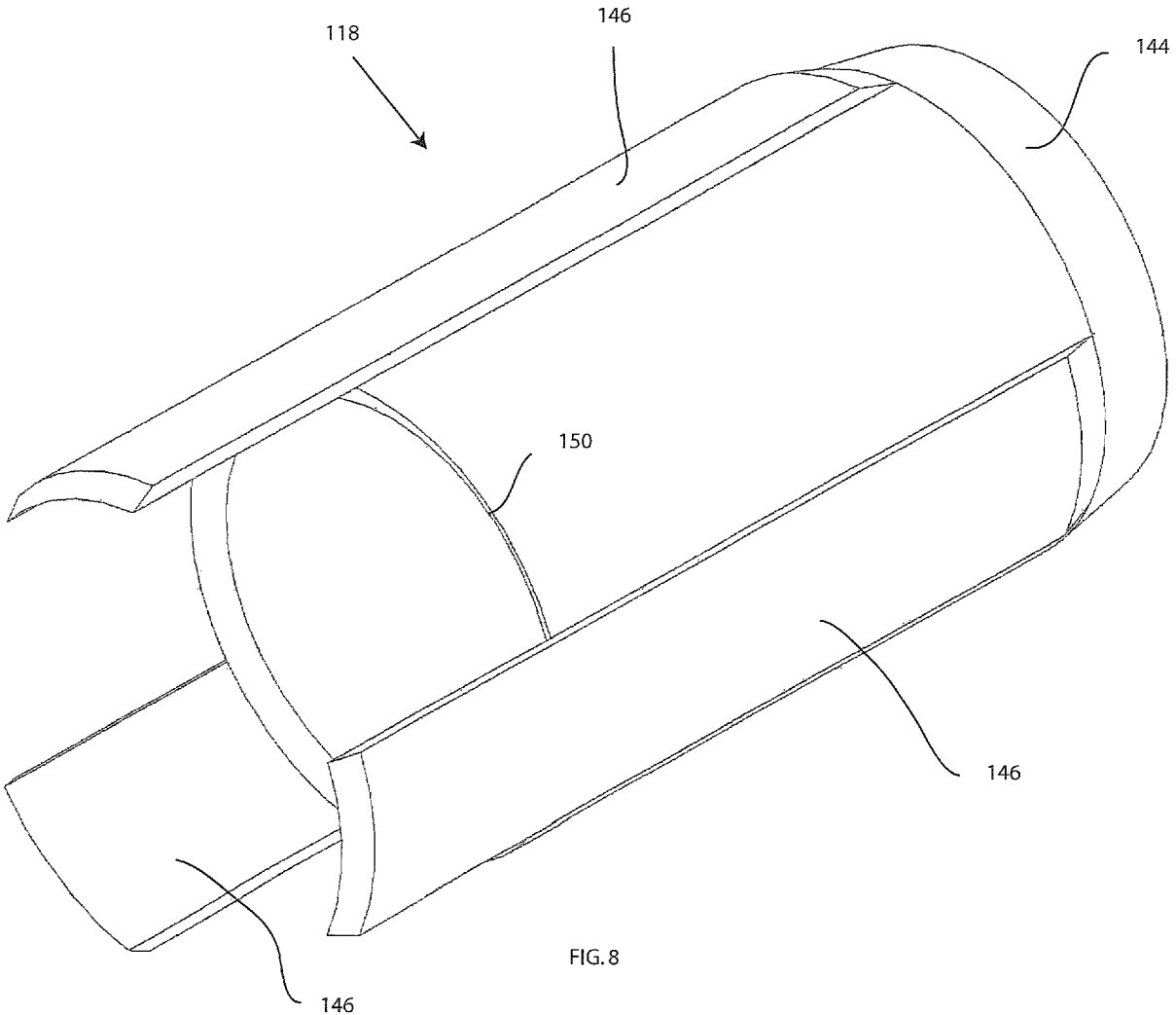
FIG. 8 depicts a second web portion of the connector sleeve of FIG. 6.

Referring now to FIGS. 6-8, another embodiment of a second connector sleeve 100 is shown. In this embodiment, the sleeve 100 also includes a first rib portion 116 consisting essentially of the first material. The sleeve 100 includes a second web portion 118 consisting essentially of the second supple material. The sleeve 100 includes a first plurality of fingers 142 extending from a first annular section 140 and a second plurality of fingers 146 extending from a second annular section 144, similar to the fingers 42, 46 and the annular sections 40, 44 of the above described sleeve 10. However, the sleeve 100 only includes three of the annular fingers 142, and three of the annular fingers 146. Thus, the widths of the annular fingers 142, 146 are larger than the widths of the fingers 42, 46 of the first sleeve 10. It should be understood that the fingers may have any appropriate width. For example, the width of the fingers of the first rib portion may be wider than the width of the fingers of the second web portion. Additionally, in some embodiments, a single, fully annular, "finger" may extend from an annular portion. In other embodiments, a connecting ring 150 may be joined to the fingers 42, 46, 142, 146 at one or more various lengths of the sleeve 10, 100 to provide structural support, as shown in FIG. 8.

Another embodiment of the present invention relates to a method for forming a sleeve, such as the sleeve 10, for a cable connector, such as the cable connector 12. The method first includes molding a first rib portion 16, such as the first rib portion 16 described hereinabove, consisting essentially of the first material. The first rib portion may include a first annular section, such as the first annular section 40 described hereinabove, and at least one finger extending therefrom, such as one of the first fingers 42. The method further includes molding a second web portion, such as the second web portion 18 described hereinabove, consisting essentially of the second supple material. The second web portion may include a second annular section, such as the second annular section 44 described hereinabove, and at least one finger extending therefrom, such as one of the second fingers 46. The first and the second portions may be attachable such that the fingers define walls of the sleeve and the annular sections define opposing ends of the sleeve. Furthermore, the method may include overmolding the second web portion with the first rib portion such that the combined first and second portions define the sleeve and wherein the sleeve is dimensioned to circumferentially surround a revolving portion of a cable connector, such as the cable connector 12. The sleeve may surround the cable connector in an interference fit such that rotation of the sleeve causes rotation of the revolving portion. Furthermore, the method may comprise inserting a revolving portion, such as the revolving portion 20, into the interference fit of the sleeve. Finally, the method may comprise molding a plurality of protrusions, such as the protrusions 48 described hereinabove, into the fingers such that the protrusions project from the inner wall of the sleeve to provide retention strength to hold the revolving portion within the sleeve.

A still further embodiment of the present invention relates to a method for engaging a connector, such as the cable connector 12, with a port, such as the port 22. The method first includes providing a sleeve, such as one of the sleeves 10, 100 described hereinabove. The method further includes engaging a revolving portion, such as the revolving portion 20 described hereinabove, with a port, such as the port 22 described hereinabove. The method may then include rotating the sleeve. Rotation of the sleeve may include a user rotating the sleeve by hand with direct contact with the user's skin. Alternately, the user may be wearing a glove or other such contact surface to prevent direct contact with the skin. In another embodiment, the user may implement a wrench or other tool to facilitate in rotation. Any means to accomplish rotation is contemplated by the present invention. It should be understood that the method may include either tightening of the cable connector on the port, for example by a clockwise rotation. Alternately, the method may include loosening the cable connector from the port, such as by a counterclockwise rotation.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A connector sleeve comprising:

a first rib portion consisting essentially of a first material, wherein the first rib portion includes a first annular section and a first finger extending from the first annular section; and a second web portion consisting essentially of a second supple material and attached to the first rib portion to define the sleeve, the second supple material softer and more elastic than the first material;

wherein the sleeve is dimensioned to circumferentially surround a revolving portion of a connector in an interference fit such that rotation of the sleeve causes rotation of the revolving portion.

2. The sleeve of claim 1, wherein the second web portion includes a second annular section and a second finger extending from the second annular section, wherein the second annular section is located on an opposite end of the sleeve than the first annular section.

3. The sleeve of claim 2, wherein the sleeve has a substantially cylindrical and hollow shape and wherein the opposing ends of the sleeve are defined substantially by the annular sections and wherein the wall between the opposing ends of the sleeve are defined substantially by the fingers.

4. The sleeve of claim 2, wherein the first rib portion includes a plurality of fingers extending from the first annular section and the second web portion includes a plurality of fingers extending from the second annular section and wherein the fingers interlock to define the sleeve.

5. The sleeve of claim 1, wherein the first material is a Polyoxymethylene plastic.

6. The sleeve of claim 1, wherein the second supple material is a silicone rubber.

7. The sleeve of claim 1, wherein the second web portion is configured to expand with the interference fit caused by the revolving portion.

8. The sleeve of claim 1, wherein the revolving portion is a hexagonal nut and the sleeve is dimensioned to circumferentially surround the hexagonal nut of the connector.

9. The sleeve of claim 1, wherein at least one of the first rib portion and the second web portion includes surface features on an inner wall configured to retain the revolving portion within the sleeve.

10. The sleeve of claim 1, wherein the inner wall of the sleeve includes an annular recess, the annular recess having a hexagonal profile dimensioned to provide the interference fit with the revolving portion of a cable connector.

11. The sleeve of claim 1, wherein at least one of the first rib portion and the second web portion have a knurled surface, wherein the knurled surface is located on an outer wall of the sleeve.

12. The sleeve of claim 1, wherein the second web portion is overmolded onto the first rib portion to form the sleeve.

13. A method of forming a sleeve for a connector comprising:

molding a first rib portion consisting essentially of a first material, the first rib portion having a first annular section and at least a first finger extending therefrom;

molding a second web portion of a sleeve consisting essentially of a second supple material, the second supple material softer and more elastic than the first material, the second web portion having a second annular section and at least a second finger extending therefrom; and joining the first and second portions such that the fingers define walls of the sleeve and the annular sections define opposing ends of the sleeve.

14. The method of claim 13, further comprising overmolding the second web portion with the first rib portion such that the combined first and second portions define the sleeve and wherein the sleeve is dimensioned to circumferentially surrounds a revolving portion of a connector in an interference fit such that rotation of the sleeve causes rotation of the revolving portion.

15. The method of claim 14, further comprising inserting a revolving portion of a connector into the interference fit of the sleeve.

16. The method of claim 13, further comprising molding a plurality of protrusions into the fingers such that the protrusions project from the inner wall of the sleeve to provide retention strength to hold a revolving portion of a connector within the sleeve.

17. A method for engaging a connector with a port comprising:

providing a cable connector with a sleeve, the sleeve including:

a first rib portion consisting essentially of a first material, wherein the first rib portion includes a first annular section and a first finger extending from the first annular section; and a second web portion consisting essentially of a second supple material, the second supple material having a greater coefficient of friction and more elastic than the first material;

wherein the sleeve circumferentially surrounds a revolving portion of a cable connector in an interference fit such that rotation of the sleeve causes rotation of the revolving portion;

engaging the revolving portion with a port; and rotating the sleeve.

18. The method of claim 17, further comprising tightening the cable connector on the port.

19. The method of claim 17, further comprising loosening the cable connector from the port.

20. A connector sleeve comprising:

a first rib portion consisting essentially of a first material, the first rib portion having a first annular section and a first finger extending therefrom, the first rib portion dimensioned to at least partially surround a revolving portion of a connector in an interference fit;

a second web portion consisting essentially of a second supple material, the second supple material softer and having a greater resistance to permanent deformation than the first material, the second web portion having a second annular section and a second finger extending therefrom; and a means for joining the first rib portion to the second web portion such that the fingers define the walls of the sleeve and the annular sections define the ends of the sleeve.

* * * * *